US005876247A

United States Patent [19]

Hashimoto

[11] Patent Number: 5,876,247

[45] Date of Patent: Mar. 2, 1999

[54] SHIELDED ELECTRICAL CONNECTOR

[75] Inventor: Shinichi Hashimoto, Tokyo, Japan

[73] Assignee: The Whitaker Corporation, Wilmington, Del.

[21] Appl. No.: 858,092

[22] Filed: May 17, 1997

[30] Foreign Application Priority Data

May 17, 1996 [JP] Japan ..... 8-123515

[51] Int. Cl.[6] ..... H01R 13/648

[52] U.S. Cl. ..... 439/607

[58] Field of Search ..... 439/607, 609, 439/610

[56] References Cited

U.S. PATENT DOCUMENTS

| | | | |
|---|---|---|---|
| 5,030,140 | 7/1991 | Sugiyama | 439/607 |
| 5,035,631 | 7/1991 | Piorunneck et al. | 439/108 |
| 5,697,799 | 12/1997 | Consoli et al. | 439/607 |

FOREIGN PATENT DOCUMENTS

| | | | |
|---|---|---|---|
| 5-21111 A | 1/1993 | Japan | H01R 13/648 |
| 6-54259 | 6/1994 | Japan | H01R 13/648 |

*Primary Examiner*—Steven L. Stephan
*Assistant Examiner*—T. C. Patel
*Attorney, Agent, or Firm*—Anton P. Ness

[57] ABSTRACT

A shied formed by a pair of substantially C-shaped metal shield plates 10,10 that have substantially the same shape and dimensions. Contact parts 13 that contact the other shield plate are defined at both ends of each shield plate. The contact parts 13,13 are edge portions of both shield plates that are accommodated together and caused to contact each other inside grooves 7 that are formed in the end wall surfaces of the housing 2. Housing-engaging projections 13*b* and 13*c* are elastically engaged with the inside wall surfaces 7*b*,7*b* of grooves 7 at points above and below the contact point embossments 13*a* with the mating shield plate, so that the shield plates are clamped inside grooves 7.

9 Claims, 6 Drawing Sheets

SHIELDED ELECTRICAL CONNECTOR

FIELD OF THE INVENTION

The present invention concerns an electrical connector in which a shield member is installed on the outside of an isulating housing.

BACKGROUND OF THE INVENTION

Conventionally, certain shielded connectors have a long, slender rectangular insulating housing made of an 1.0 insulating synthetic resin, and are attached to a circuit board so that the connectors can receive a mating connector from a direction that is substantially perpendicular to the surface of the circuit board. The shield member is installed on the outside of the housing and has plate surfaces that are substantially parallel to the direction from which the mating connector is received. For example, see Japanese Patent Application Kokai No. 5-74522, Japanese Utility Model Application Kokai No. 6-54259 and Japanese Patent Application Kokai No. 5-21111.

However, conventional shielded connectors of this type have proved to be unsatisfactory in the following respects: i. e., the shielding characteristics are inadequate, a high degree of dimensional precision is required for assembly, and the manufacturing process is complicated.

For example, in the connector described in Japanese Patent Application Kokai No. 5-74522 mentioned above, two metal plates are installed as shield members on both sides of the housing; however, since there are no shield members on the ends of the housing, the shielding characteristics are inadequate. The connector described in Japanese Utility Model Application Kokai No. 6-54259 is equipped with a rectangular frame-form metal shield as a shield member, and therefore has good shielding characteristics; however, since the shield member is formed as a frame, a high degree of dimensional precision is required in order to attach this frame to the housing. In the connector described in Japanese Patent Application Kokai No. 5-21111, the housing is shielded by applying a conductive plating to the outside of the housing; accordingly, although this connector similarly has good shielding characteristics, the manufacturing process is complicated so that the cost of the connector is increased.

Thus, the object of the present invention is to provide a shield type connector which solves all of the problems described above.

SUMMARY OF THE INVENTION

The object of the present invention is to provide a shield type connector which has superior shielding characteristics, but which can nevertheless be inexpensively manufactured with no need for a high degree of dimensional precision.

In the present invention, a shield member is constructed from a pair of substantially C-shaped metal shield plates, and contact parts which contact the mating shield plate are disposed at both ends of each shield plate. Accordingly, when the shield plates are attached to the housing, the shield plates form a rectangular frame so that superior shielding characteristics are obtained. The shield member is split into two shield plates, and can be inexpensively manufactured and easily assembled, without any requirement for a high degree of dimensional precision when the shield member is attached to the housing.

Furthermore, the contact parts of both shield plates are accommodated together and caused to contact each other inside grooves formed in the end wall surfaces of the housing. The contact parts of each shield plate are elastically engaged with the inside wall surfaces of the grooves at positions located above and below the points of contact with the contact parts of the other shield plate with the points of contact of these contact parts as supporting points, so that the contact parts are clamped in place inside the grooves. As a result, both shield plates can be securely fastened to the housing at the positions of these contact parts; moreover, a force which increases the contact pressure is elastically applied to the contact point of the contact parts, so that a stable contact state is obtained.

A working configuration of the shielded connector of the present invention will now be described by way of example with reference to the attached drawings.

BRIEF DESCRIPTION OF THE DRAWINGS

FIG. 13 is an enlarged view of essential parts including the contact part shown in the upper right corner portion of the back view of the shield plate shown in FIG. 8;

DETAILED DESCRIPTION OF THE EMBODIMENT

Figure 6:
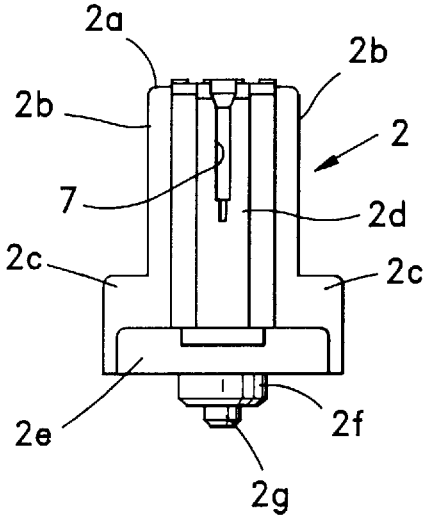
FIGS. 5 and 6 are front and right-side views of the housing of the connector of FIGS. 1 to 4.

FIGS. 1 through 4 illustrate the construction of a shield type connector constituting one embodiment of the present invention. FIGS. 5 and 6 are a front view and a right-side view of the housing, and FIGS. 7 through 10 are a front view, a back view, a plan view and a right-side view of one of the shield plates.

The shielded connector 1 of the working configuration illustrated in FIGS. 1 through 4 is constructed so that it can be attached to the surface of a circuit board (not shown) in such a manner that the mating connector can be received from a direction that is substantially perpendicular to the surface of the circuit board. Connector 1 is equipped with a long, slender rectangular housing 2 formed from an insulating synthetic resin such as the housing shown in FIGS. 5 and 6. Connector-receiving cavity 3 for receiving the mating connector (not shown), is formed in the direction of length in the upper surface 2*a* of the housing 2. Inside connector-receiving cavity 3 and along side walls thereof, are disposed numerous contacts 4 (FIG. 1) that electrically contact numerous terminal parts formed on the mating connector. The lower end portions of the contacts 4 protrude from the bottom surface of housing 2 and form tine parts 4a that are inserted into holes of a circuit board and soldered therein.

As is clear from FIG. 6, housing 2 has the shape of an inverted "T" when viewed from the side. Housing 2 is equipped with side wall surfaces 2*b*,2*b* that are substantially perpendicular to the surface of the circuit board to which connector 1 is attached; side edge parts 2*c*,2*c* bulge outward from the lower portions of the side wall surface 2*b*,2*b*. End wall surfaces 2*d*,2*d* are substantially perpendicular to both the surface of the circuit board and side wall surfaces 2*b*,2*b*. Mounting flanges 2*e*,2*e*are equipped with screw holes 5 and protrude outward from the lower portions of end wall surfaces 2*d*,2*d*, enabling connector 1 to be mechanically fastened to the circuit board by means of screws. Boss parts 2*f* protrude coaxially with screw holes 5 from the bottom surfaces of mounting flanges 2*e*, and the screw holes 5 pass through boss parts 2*f*. Furthermore, projections 2*g*,2*g* that are used to position connector 1 on the circuit board, are caused to protrude from the bottom surface of housing 2 to the inside of boss parts 2*f*,2*f*.

Figure 9:
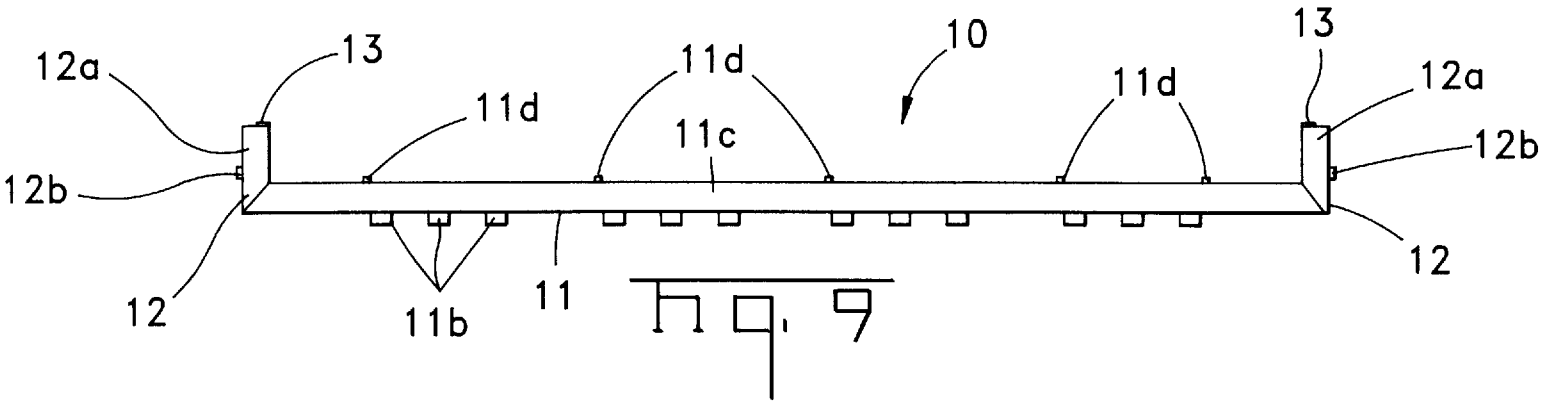
FIGS. 7 to 9 are front, back and plan views of one of the shield plates of the present invention.

A pair of metal shield plates 10,10 are installed on the outside of housing 2 and have substantially the same shape and dimensions, and provide plate surfaces that are substantially parallel to the direction from which the mating connector is received. As is shown in FIGS. 7 through 10, each of these shield plates 10 is formed from a main plate part 11 that is attached to one of the side wall surfaces 2*b* of housing 2, and end plate parts 12,12 are bent substantially at right angles from both ends of main plate part 11. End plate parts 12,12 extend along the end wall surfaces 2*d* of housing 2 to positions located at the centers of end wall surfaces 2*d*, so that each shield plate 10 is substantially C-shaped (as shown in FIG. 9). End portions of the respective end plate parts 12 are further bent inward substantially at right angles to form edge portions 13 that contact those of the other shield plate.

A plurality of grounding tine parts 11*a* and a plurality of elastic parts 11*b* that are formed between the tine parts 11*a*,11*a* and that are shorter than the tine parts 11*a*, are formed along the lower edge of the main plate part 11 of each shield plate 10 so that these tine parts 11*a* and elastic parts 11*b* protrude downward. An upper edge part 11*c* is formed on the upper edge of main plate part 11 and is bent inward in a "C" shape as seen from the side in FIGS. 8 and 14. Moreover, as is shown in FIG. 8, a plurality of contact parts lid project downward from the inside of upper edge part 11*c*. Latch parts 11*e*,11*e* are formed in the upper portion of main plate part 11 at both ends by grooves that are cut out in a "C" shape. Upper edge parts 12*a* are formed on the upper edges of end plate parts 12 of each shield plate 10 and are bent inward, and resilient tabs 12*b* project downward from the lower edges of end plate parts 12.

The pair of shield plates 10,10 constructed as described above are mounted on housing 2 from above. As is clear from FIG. 4, openings 6,6 that allow the tine parts 11*a* and the elastic parts 11*b* of the main plate parts 11 of the shield plates 10 to pass through, are formed in the side edge parts 2*c*,2*c* of housing 2. As is clear from FIG. 6, grooves 7 are formed in the respective end wall surfaces 2*d* of housing 2 and extend in the vertical direction and are open at the top; grooves 7 are used to receive edge portions 13,13 of the respective shield plates 10,10 and to hold them in an engaged or contact state. Moreover, as is shown in FIG. 5, recesses 8,8 are formed in the respective side wall surfaces 2*b* of housing 2 and anchor the shield plates 10 in specified positions by respectively engaging with the latch parts 11*e*,11*e* formed in the main plate parts 11 of the shield plates.

Figure 1:
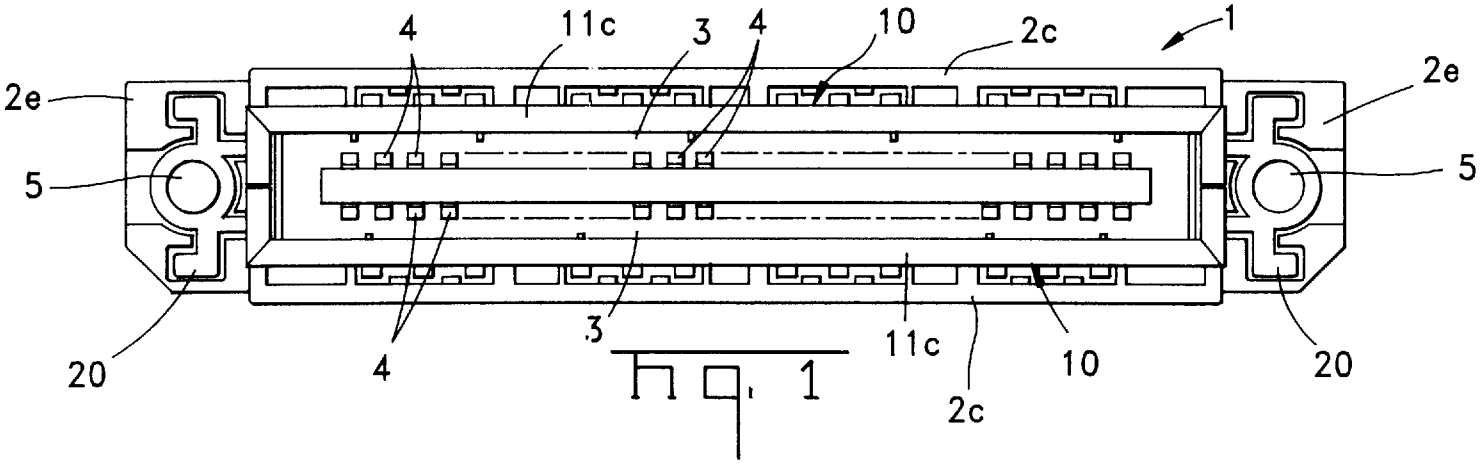
FIG. 1 is a plan view which illustrates the construction of a shield type connector constituting one working configuration of the present invention.
Figure 2:
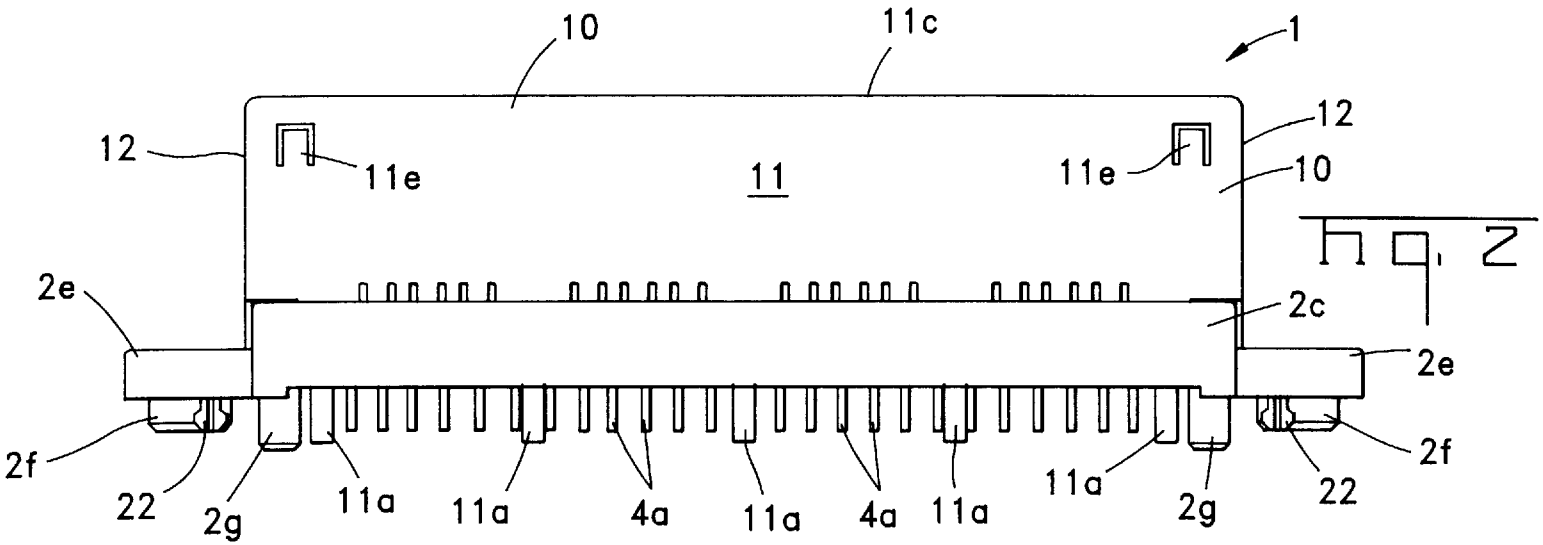
FIGS. 2 and 3 are elevation and right-side views of the connector of FIG. 1.
Figure 3:
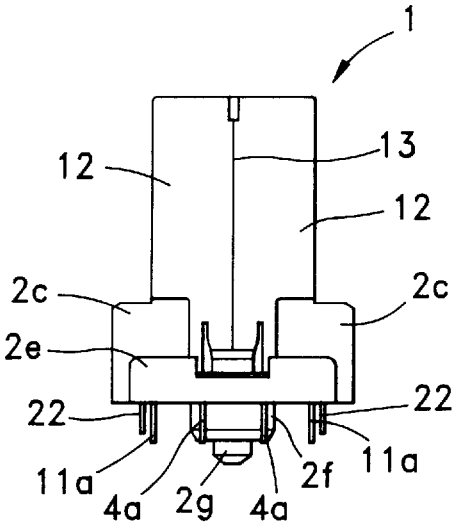
Figure 4:
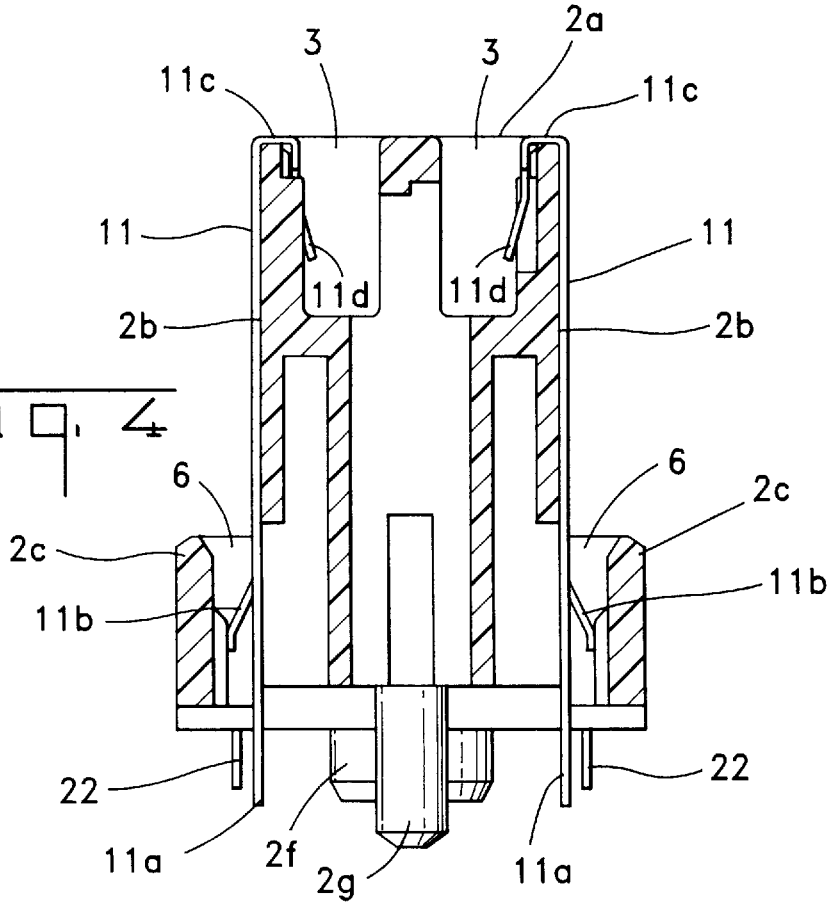
FIG. 4 is an enlarged sectional view of the connector of FIGS. 1 to 3 with the contacts omitted.
Figure 5:
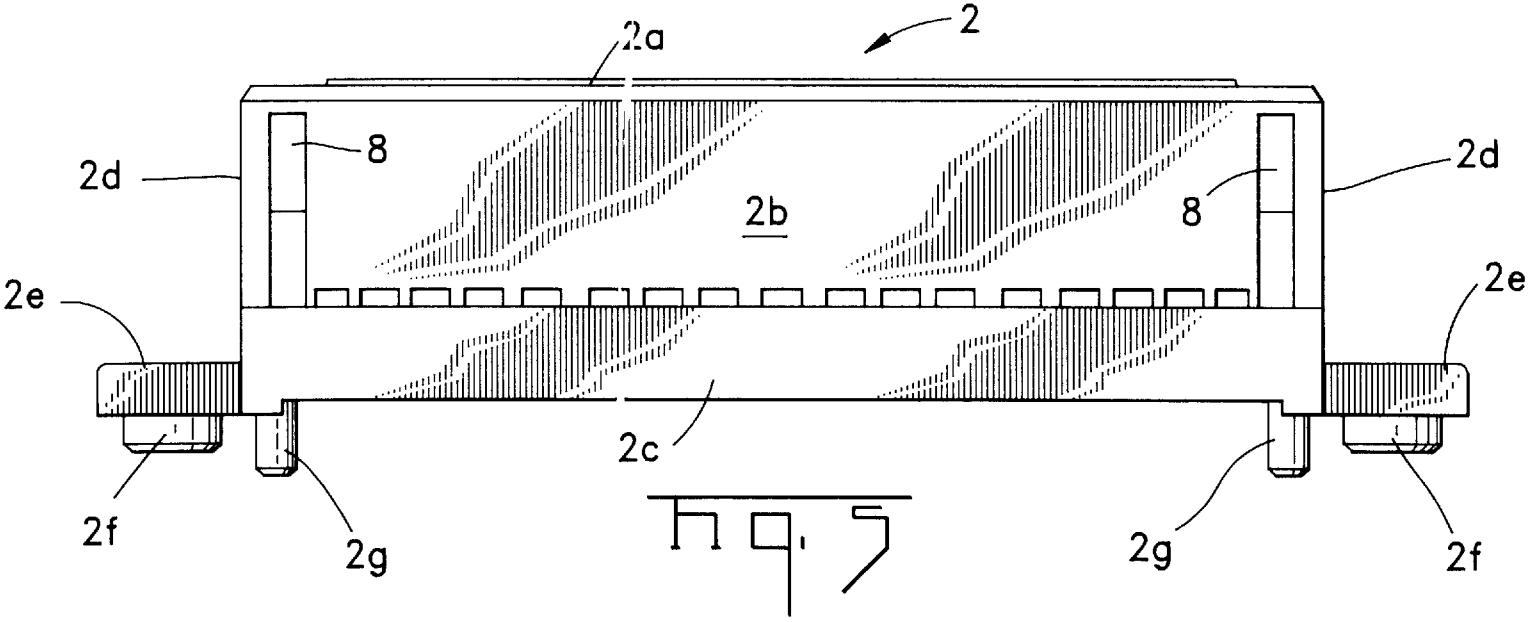
Figures 1, 7, 8:
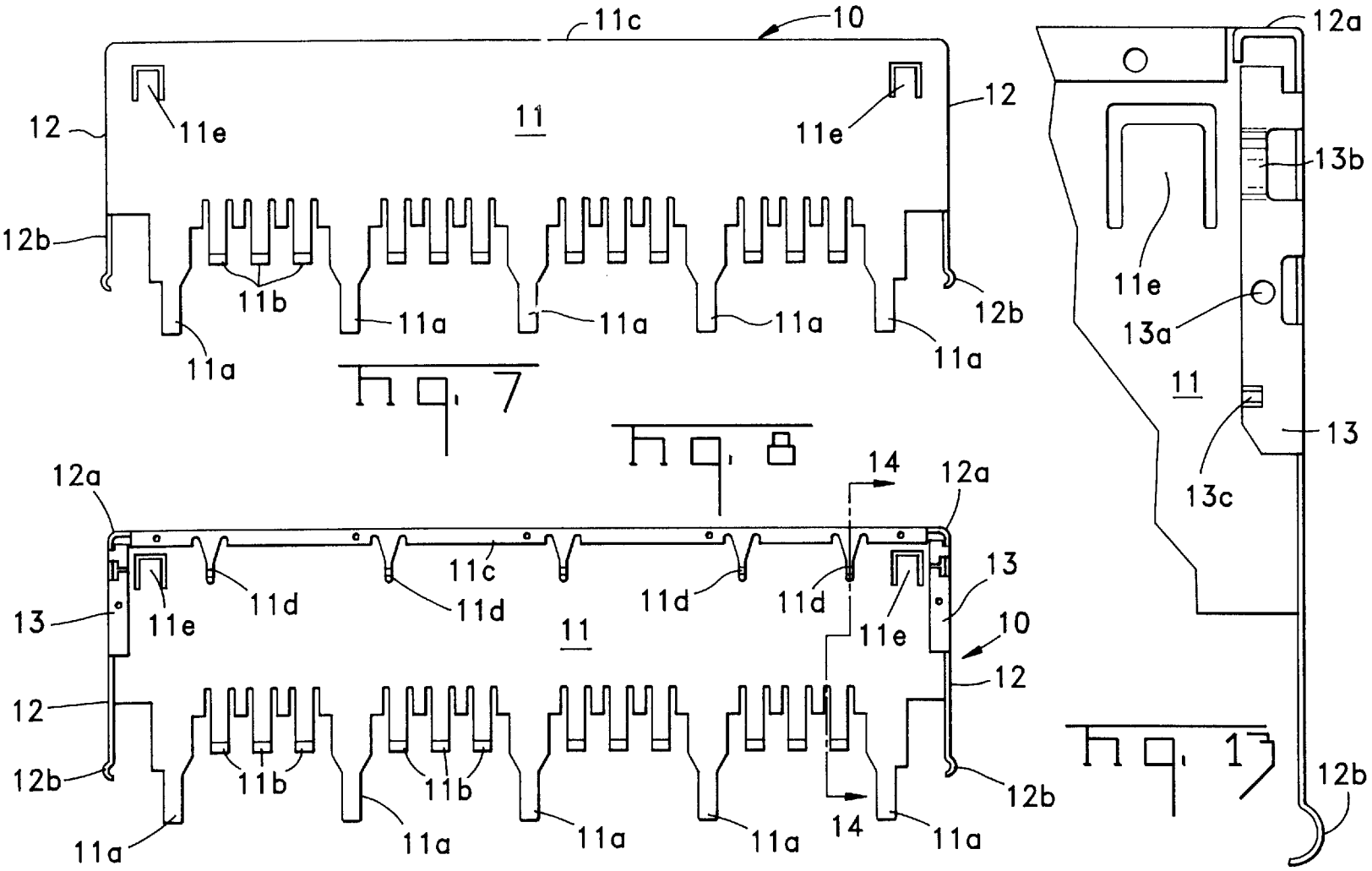
Figure 10:
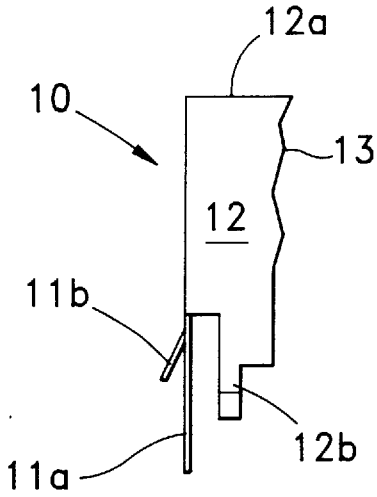
FIG. 10 is an enlarged partial view of an end of one of the shield plates of FIGS. 7 to 9.

As a result of housing 2 and shield plates 10 being constructed as described above, the grounding tine parts 11*a* of the main plate parts 11 protrude from the bottom surface of housing 2 as shown in FIGS. 1, 3 and 4 when shield plates 10,10 are mounted on the housing 2 from above and anchored in specified positions. These tine parts 11*a* are inserted into holes formed in the circuit board, and are grounded by soldering. Upper edge parts 11*c* of the respective main plate parts 11 of shield plates 10,10 turn inward into the connector-receiving cavity 3 from the upper surface 2*a* of housing 2, and resilient fingers 11*d* protrude into the interior of connector-receiving cavity 3, so that when a mating connector is received in connector-receiving cavity 3, the resilient fingers 11*d* elastically contact the shield plates (not shown) covering the outside of the mating connector and thus ground them. Elastic parts 11*b* formed on the main plate parts 11 contact portions of the shield plates of the mating connector that optionally may be used to cover side edge portions of the mating connector's housing (not shown) that are inserted into the openings 6, and thus ground the shield plates thereat.

Figure 12:
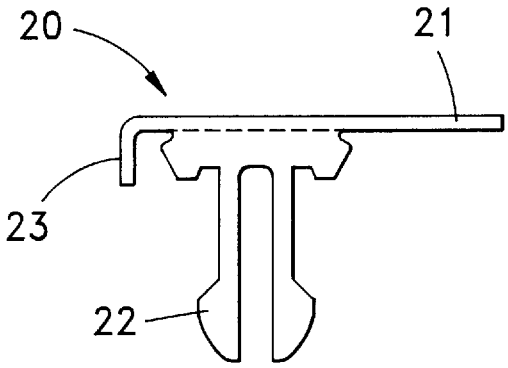
FIGS. 11 and 12 are plan and elevation views of one of the grounding plates that are installed on the mounting flanges of the housing of FIGS. 5 and 6.
Figure 11:
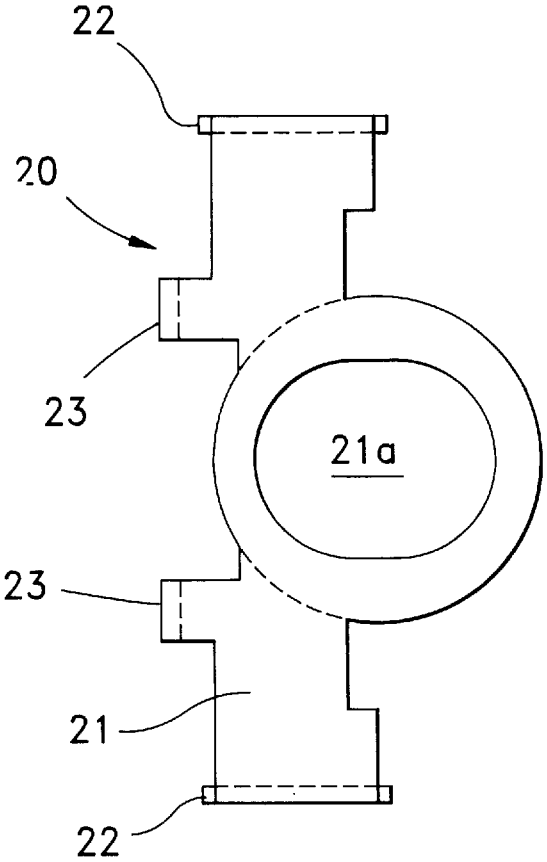

After shield plates 10, 10 have been mounted on housing 2, additional plates 20 (shown enlarged in FIG. 11, and in FIG. 12) are attached to the surfaces of the respective mounting flanges 2*e* of housing 2. Each additional plate 20 has a flat plate part 21 equipped with a screw hole 21*a* that conforms to the screw hole 5 formed in the corresponding mounting flanges 2*e*, leg parts 22,22 that are bent downward substantially at right angles from both ends of the flat plate part 21, and tab portions 23,23 that are bent downward substantially at right angles from an edge part of the flat plate part 21 that is substantially perpendicular to the edge parts on which leg parts 22,22 are formed. Board-engaging leg parts 22,22 act to fasten the additional plates 20 to the mounting flanges 2*e* of the housing 2. Tab portions 23,23 are formed in specified positions at a specified spacing so that tab portions 23,23 contact the resilient tabs 12*b*,12*b* that protrude downward from the lower edges of end plate parts 12,12 of shield plates 10,10.

Figure 14:
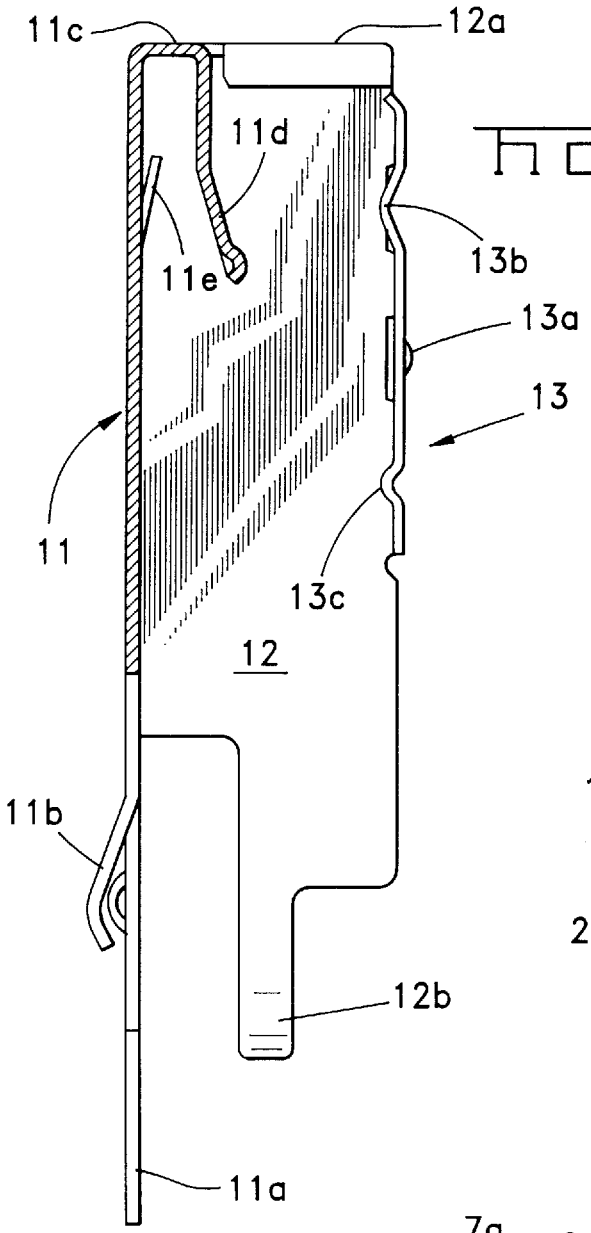
FIG. 14 is an enlarged sectional view of the shield plate of FIG. 8 along lines 14—14 thereof.
Figure 15:
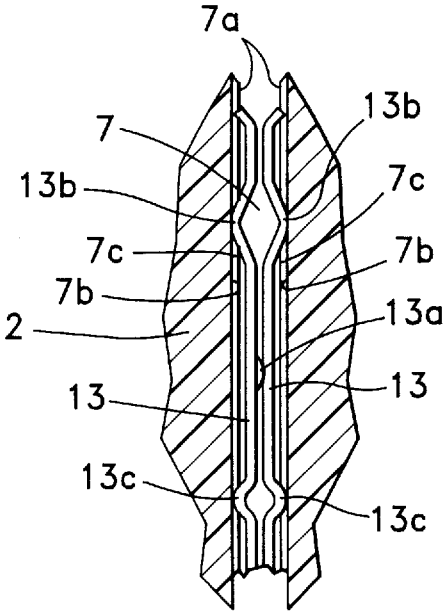
FIG. 15 is a sectional view illustrating a state in which the contact parts of the shield plates are accommodated inside one of the grooves, and are in mutual contact.
Figure 16:
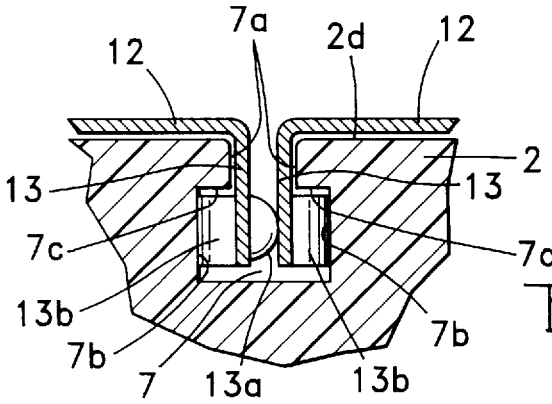
FIG. 16 is an enlarged sectional view showing the state illustrated in FIG. 15 as viewed from above.

FIG. 13 is an enlarged view of essential parts which includes edge portion 13 shown in the upper right corner portion of the back view of shield plate 10 shown in FIG. 8. FIG. 14 is an enlarged sectional view along lines 14—14 in FIG. 8. Furthermore, FIG. 15 is a sectional view illustrating a state in which the edge portions 13,13 of the shield plates 10,10 are accommodated inside one of the grooves 7, and are in mutual contact. FIG. 16 is an enlarged sectional view showing the state illustrated in FIG. 15 as viewed from above.

An embossment 13*a* and housing-engaging projections 13*b* and 13*c* are formed on each edge portion 13 of one shield plate 10. Embossment 13*a* acts as a contact point for the corresponding edge portion 13 of the other shield plate 10. Housing-engaging projections 13*b* and 13*c* protrude on the opposite side of edge portion 13 from embossment 13*a* at points located above and below embossment 13*a*. Furthermore, as is shown in FIGS. 15 and 16, no embossments 13*a* are formed on edge portions 13 of the right-hand shield plate 10; on these edge portions 13, only similar housing-engaging projections 13*b* and 13*c* are formed in positions corresponding to the positions of the engaging housingprojections 13*b* and 13*c* on edge portions 13 of the left-hand shield plate 10.

As is clear from FIG. 16, grooves 7 that are cut into the respective end wall surfaces 2*d* of housing 2 and that receive the edge portions 13,13 of both shield plates 10,10, are formed so that the width of the space between inside wall surfaces 7*b*,7*b* in widened interior portions or undercuts of grooves 7 is greater than the width of the space between inside wall surfaces 7*a*,7*a* at openings formed in end wall surfaces 2*d*. Thus, step parts 7*c* are formed between the respective inside wall surfaces 7*a* and 7*b*. Respective edge portions 13,13 are clamped in place inside grooves 7 in a configuration in which housing-engaging projections 13*b* and 13*c* are elastically engaged with inside wall surfaces 7*b*,7*b* in the interior portions of grooves 7 at points above and below embossments 13*a* that constitute contact points with the other shield plate 10, with embossments 13*a* acting as supporting points.

Accordingly, the side edges of end plate parts 12, 12 of respective shield plates 10,10 can be securely fastened to housing 2. Furthermore, a force oriented in the direction that increases the contact pressure acts elastically on the contact points of the respective edge portions 13,13, so that a stable contact state can be obtained.

In particular, since respective step parts 7*c* are formed between the inside wall surfaces 7*a* and 7*b* of grooves 7, even if a force should be applied in a direction that opens the side edges of end plate parts 12,12 of shield plates 10,10, the housing-engaging projections 13*b* and 13*c* of the respective edge portions 13,13 are anchored by step parts 7*c*, 7*c* so that opening of the side edges of end plate parts 12,12 is prevented.

In the present working configuration, the connector shield is constructed from a pair of substantially C-shaped metal shield plates 10,10, and edge portions 13,13 of each shield plate that contact the other shield plate are disposed at both ends of each shield plate 10. Accordingly, when shield plates 10,10 are attached to housing 2, the shield plates form a rectangular frame so that superior shielding characteristics are obtained. Since the shield is split into two shield plates 10,10, the shield can be inexpensively manufactured and easily assembled, without any requirement for a high degree of dimensional precision when the shield is attached to the housing.

Modifications and variations may be made to the specific embodiments disclosed herein and are within the spirit of the invention and the scope of the claims.

What is claimed is:

1. A shielded connector comprising:

an elongate insulative housing having a mating face to receive a mating connector thereinto, and having a shield installed on the outside of the housing with plate surfaces along side walls of said housing and are substantially parallel to the direction from which the mating connector is received;

said shield including a pair of metal shield plates have substantially the same shape and dimensions and have main plate parts defining said plate surfaces and further having end plate parts bent substantially at right angles from both ends of said main plate parts;

each said shield plate further including end portions of respective said end plate parts bent inwardly substantially at right angles to form edge portions that contact the mating shield plate; and said edge portions are accommodated together and contact each other at points of contact inside grooves formed in wall surfaces at both ends of said housing, and said edge portions are elastically engaged with inside wall surfaces of said grooves at selected positions so that said edge portions are clamped in place inside said grooves.

2. The shielded connector as set forth in claim 1 wherein said points of contact comprise embossments extending from said edge portion of one said shield plate to said edge portion of the other said shield plate.

3. The shielded connector as set forth in claim 1 wherein said edge portions of each said shield plate include resilient housing-engaging projections located above and below said points of contact, that engage wall surfaces of said grooves to urge each said edge portion toward said edge portion of said other shield plate.

4. The shielded connector as set forth in claim 3 wherein said wall surfaces engaged by said housing-engaging projections are defined along widened interior groove portions.

5. The shielded connector as set forth in claim 1 wherein latch parts of each said shield plate latchingly engage cooperating latch surfaces of said housing to secure said shield plate to said housing.

6. The shielded connector as set forth in claim 1 wherein each said shield plate includes an upper edge part bent to extend into a connector-receiving cavity defined into said mating face of said housing and along wall surfaces of said connector-receiving cavity, and each said upper edge part includes resilient fingers protruding into said connector-receiving cavity to engage a shield of a mating connector received thereinto.

7. The shielded connector as set forth in claim 1 wherein each said shield plate includes spring arms extending outwardly from said main plate parts to engage a shield plate of a mating connector.

8. The shielded connector as set forth in claim 1 wherein said connector includes a board-mounting face opposed to said mating face, and said shield plates include grounding tine parts extending from said main plate parts beyond said board-mounting face for engagement with ground circuits of a circuit board to which said connector is mounted.

9. The shielded connector as set forth in claim 8 wherein said housing includes apertured mounting flanges extending from ends thereof adjacent said board-mounting face, and said shield further includes additional shield plates securable over said mounting flanges, that have a pair of tab portions engageable by resilient tabs of said end plate parts of both said shield plates and further include board-engaging legs depending below said board-mounting face.

* * * * *